United States Patent [19]

Nguyen

[11] Patent Number: 4,522,185

[45] Date of Patent: Jun. 11, 1985

[54] SWITCHING ELECTRONIC IGNITION

[76] Inventor: Minh-Tri Nguyen, 2602 S. Pacific Ave., Santa Ana, Calif. 92704

[21] Appl. No.: 551,060

[22] Filed: Nov. 14, 1983

[51] Int. Cl.[3] ..... F02P 15/08

[52] U.S. Cl. ..... 123/637; 123/606; 123/623

[58] Field of Search ..... 123/623, 626, 637, 650, 123/606, 598

[56] References Cited

U.S. PATENT DOCUMENTS

| | | | |
|---|---|---|---|
| 3,945,362 | 3/1976 | Neuman et al. | 123/606 |
| 4,068,643 | 1/1978 | McKechnie | 123/637 |
| 4,097,770 | 6/1978 | Fisher | 123/598 |
| 4,112,890 | 9/1978 | Manger et al. | 123/606 |
| 4,131,100 | 12/1978 | Merrick | 123/598 |
| 4,149,508 | 4/1979 | Kirk, Jr. et al. | 123/637 |

*Primary Examiner*—Parshotam S. Lall

*Attorney, Agent, or Firm*—Leonard Tachner

[57] ABSTRACT

This electronic ignition system comprises a unique combination of a high voltage switching regulator to provide substantially higher voltage to the ignition coil and a solid state power switch to produce a constant high energy ignition current of multiple repetitions for a selected duration dependent upon engine speed. The power switch is controlled by a pulser and a window generator which respond to virtually any available trigger source including conventional breaker points and generates an engine speed dependent window signal the duration of which defines the ignition energy characteristics.

16 Claims, 14 Drawing Figures

SWITCHING ELECTRONIC IGNITION

BACKGROUND OF THE INVENTION

1. Field of the Invention

This invention relates generally to ignition systems for internal combustion engines and more specifically, to an improved electronic ignition for supplying high voltage pulses to spark plugs for engines used in automobiles, motorcycles, boats, airplanes, and the like.

2. Prior Art

Ignition systems for firing spark plugs in automobile engines and the like comprises an old art dating back to the early part of the 20th century and a great many patents have been issued in that art. Conventional ignition systems comprising a battery, an ignition coil, a condenser (capacitor), breaker points and a distributor, have been used virtually universally for decades but have produced a number of disadvantages related to durability and performance and the effect on the frequency of engine tune-up requirements. Accordingly, in about the mid 1960's with the advent of advances in solid state electronics, transistorized electronic ignition systems became available. Since that time, a number of improvements have been made and today virtually all automobile manufacturers provide either inductive-discharge ignition systems or capacitive-discharge ignition systems in their products. The inductive-discharge ignition system uses a transistor to cut-off the current flowing in the primary winding of the ignition coil instead or using breaker points of the conventional system. Typical capacitive-discharge ignition systems use a silicon controlled rectifier (SCR) to discharge a previously charged capacitor through the primary winding. Detailed examples of electronic ignition systems of the prior art and their relative advantages over the aforementioned conventional ignition systems are provided in a book entitled "Electronic Ignition Systems" by Marvin Tepper, published by the Hayden Book Company, Copyright 1977. Such prior art electronic ignitions find their principal advantage relative to the previous non-electronic ignitions in alleviating the short term problems. Such problems were previously encountered primarily with breaker points which required frequent replacement due to high current induced rapid wear. Electronic ignitions make it possible to replace such breaker points with a different form of triggering device for the first time made compatible with internal combustion engines.

Unfortunately, many of the problems previously associated with conventional ignition systems are not solved by the electronic ignition systems of the prior art. For example, prior art electronic ignition systems still suffer the disadvantage of a decreasing high voltage output at the spark plug particularly as engine speed increases. Furthermore, spark duration is still relatively short at between 0.5 and 2 microseconds, thus severely limiting the amount of energy that is delivered by the spark plug within the explosive chamber. Furthermore, the number of spark plug ignitions that induce the combustion process is too low and as a result, the combustion effect is not as efficient as it should be and spark plugs become fouled, causing misfirings and frequent cleaning, replacement or tuneups are often needed.

SUMMARY OF THE INVENTION

The present invention overcomes the aforementioned disadvantages of the prior art by providing an electronic ignition system that delivers a substantially higher voltage, that produces a greater energy output, that increases the number and frequency of the spark ignitions and thus increases the efficency of the combustion process and reduces the likelihood of spark plug fouling. Furthermore, the present invention provides an ignition system which results in a substantially constant, ignition coil voltage at all engine speeds thus eliminating the problem associated with the prior art wherein the performance of the electronic ignition system is rendered non-uniform as a function of engine speed. Furthermore, it will be seen hereinafter that the novel ignition system of the present invention accommodates a variety of different trigger signals thus rendering it compatible with virtually all available sensing devices which provide the appropriate trigger signals as a function of engine speed and the number of engine cylinders. Furthermore, it will be seen hereinafter that the electronic ignition of the present invention obviates the conventional ballast resistor of prior art devices which was originally introduced into conventional ignition systems to provide current limiting action, to protect the ignition coil at low engine speeds and which has been maintained in transistor ignition systems in an effort to maintain as much as possible, a constant value of current flow and voltage drop in the primary of the ignition coil.

To achieve the noted advantages relative to the aforementioned prior art, the present invention utilizes a novel combination of a high voltage switching regulator to provide substantially higher DC voltage to the primary winding and a solid state power switch controlled by pulse generating electronic circuitry to produce a primary switching current of a constant amplitude for a predetermined period of time thereby delivering about an order of magnitude greater energy to the primary winding than is delivered by prior art electronic ignition systems. Furthermore, it will be seen that the switching electronic ignition system of the present invention produces sharply defined electrical pulses of substantially constant amplitude and constant spark duration combined with a high repetition rate of ignition whereby at least five sparks are utilized for each ignition cycle irrespective of the rate of engine speed.

OBJECTS OF THE INVENTION

It is therefore a principal object of the present invention to provide a novel electronic ignition system which entirely overcomes or substantially reduces the noted disadvantages of conventional ignition systems as well as electronic ignition systems of the prior art.

It is an additional object of the present invention to provide a switching electronic ignition system for internal combustion engines which delivers a higher voltage to the ignition coil than is delivered by electronic ignitions of the prior art.

It is still an additional object of the present invention to provide a switching electronic ignition which delivers a greater energy output than is delivered by electronic ignitions of the prior art.

It is an additional object of the present invention to provide a switching electronic ignition which provides a spark having a greater repetition frequency for each cycle of spark plug ignition.

It is still a further object of the present invention to provide a switching electronic ignition system which generates a substantially constant secondary ignition coil voltage at all engine speeds.

It is still an additional object of the present invention to provide a switching electronic ignition system which accommodates substantially all different types of ignition trigger signal sources and which also obviates the use of an ignition ballast resistor.

BRIEF DESCRIPTION OF THE DRAWINGS

The aforementioned objects and advantages of the present invention as well as additional objects and advantages thereof will be further understood hereinafter as a result of a detailed description of the invention when taken in conjunction with the following drawings in which:

FIG. 3, comprising

DETAILED DESCRIPTION OF A PREFERRED EMBODIMENT

Figure 1:
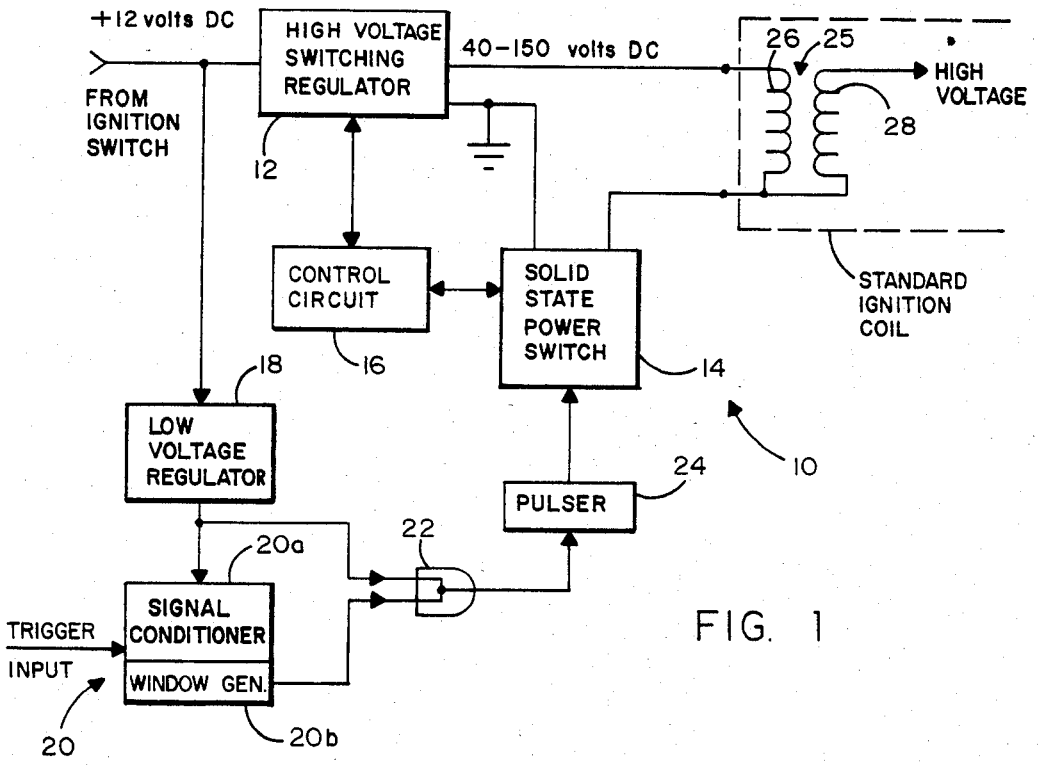
FIG. 1 is a block diagram of the invention.

Referring to FIG. 1 it will be seen that the switching electronic ignition 10 of the present invention comprises a high voltage switching regulator 12, a solid state power switch 14, a control circuit 16, a low voltage regulator 18, a signal conditioner and window generator 20, an AND gate 22, and a pulser 24. High voltage switching regulator 12 receives the battery voltage, typically +12 volts DC, from the ignition switch (not shown) and provides a selectable voltage in the range of 40–150 volts DC to the primary winding 26 of an ignition coil 25 shown in the upper right-hand corner of FIG. 1. As is well-known, the ignition coil 25 also provides a secondary winding 28 which significantly steps up the voltage for application to the spark plugs typically through a distributor in accordance with the number of cylinders of the engine.

Solid state power switch 14 provides a switchable path between primary winding 26 and ground (chassis). When solid state switch 14 receives pulses from the pulser, a switching current through primary winding 26 results and induces a high voltage in the secondary winding 28 which may be delivered to the spark plugs as previously indicated. A control circuit 16, which interfaces with both the high voltage switching regulator 12 and solid state power switch 14, provides associated circuit control of each of these devices as will be described hereinafter in more detail in conjunction with FIG. 3.

As shown in the lower left-hand portion of FIG. 1, battery voltage from the ignition switch is also applied to a low voltage regulator 18 the purpose of which is to provide regulated 5 volts DC to portions of the apparatus. One of the components to which the low voltage regulator 18 provides 5 volts DC is the signal conditioner and window 20. The signal conditioner receives a trigger input and, in turn, triggers the window generator for timing the application of high voltage to the spark plugs at secondary winding 28 of ignition coil 25. Signal conditioner 20*a* provides the switching electronic ignition 10 of the present invention with one of its highly advantageous features, namely, compatibility with a variety of different types of trigger sources such as conventional points, magnetic pick-up, magnetic coils, Hall effect devices, Wiegand effect devices, optical triggers and many more. Signal conditioner 20*a* is designed to respond to virtually any shape waveform trigger input such as for example, a square wave, a sine wave, a sawtooth or a narrow pulse. The window generator 20*b* provides a clean output pulse signal the duration of which may be selectively varied in accordance with ignition energy requirements for a particular engine and engine speeds. By way of example, in one embodiment of the invention a duration or window of 2.5 milliseconds has been selected for engine speeds below 1,000 RPM and a duration or window of 1.2 milliseconds has been selected for engine speeds above 3,000 RPM and will vary linearly therebetween inversely proportional to engine speed.

The output of window generator 20*b* is applied as one input to an AND gate 22 and the second input of the AND gate is connected to low voltage regulator 18 for receiving a constant +5 volts DC. The purpose of AND gate 22 is to provide the +5 volts DC voltage to a pulser 24 but only during the aforementioned signal durations or windows generated at the output of window generator 20. Pulser 24 produces a series of pulses for the period it receives a +5 volts DC output from AND gate 22 which period is equal to the duration of the window signal generated by signal conditioner and window generator 20*b*. The pulses produced by pulser 24 are applied to solid state power switch 14 which connects the primary winding 26 of ignition coil 25 to ground in response to each such pulse. Thus typically, where the duration of the signal generated by window generator 20 is 1.2 milliseconds, pulser 24 will produce a minimum of 5 sparks over that duration resulting in ignition of each spark plug, five corresponding times during each cycle.

Figure 2:
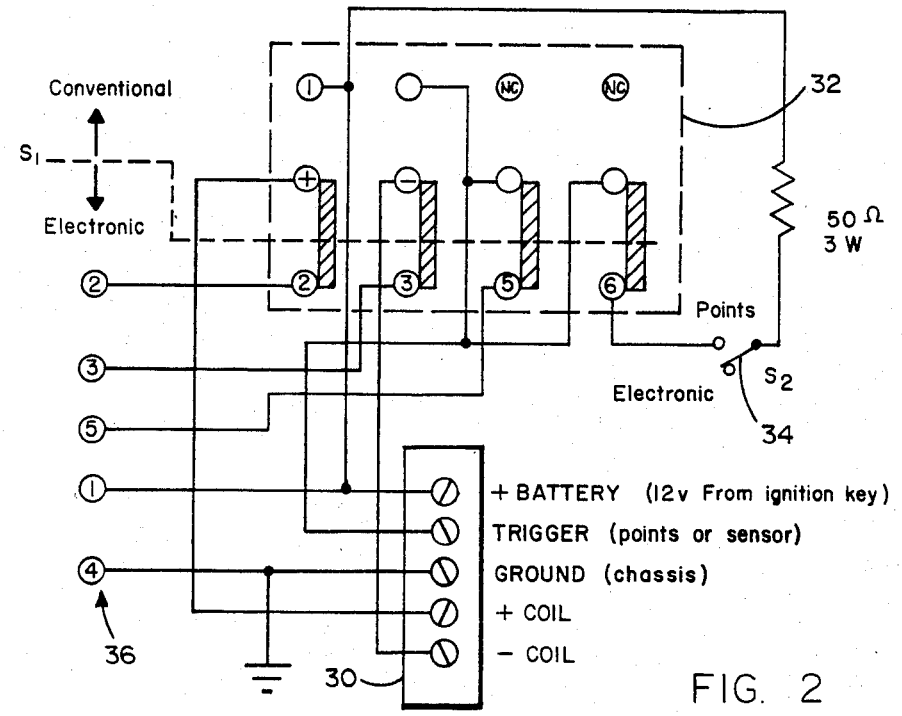
FIG. 2 is a block diagram of a switching arrangement used in the invention.

The preferred implementation of the switching electronic ignition of the present invention will now be discussed in conjunction with FIGS. 2 and 3 wherein FIG. 2 illustrates a switching and interconnection implementation for installation of the invention that permits the user to selectively choose between use of the electronic ignition of the invention or use of conventional point ignition to bypass the electronic ignition in case of component failure. FIG. 3 on the other hand, provides a detailed schematic diagram illustrating the components that comprise the functional blocks previously discussed in conjunction with FIG. 1.

Referring first to FIG. 2 it will be seen that the invention comprises a junction terminal 30, a multi-pole switch 32 and a single pole switch 34. As seen in FIG. 2 the terminal junction 30 provides terminals for connecting the switching electronic ignition of the invention to +12 Volt battery from the ignition key, the trigger source, chassis ground of the engine and the respective positive and negative connections of the primary winding of coil 25.

When switch 32 is in the position indicated in FIG. 2 corresponding to activation of the electronic ignition of the invention, the output terminals 2 and 3 (see FIG. 3*a*) of the electronic ignition herein disclosed, are connected respectively to the positive and negative primary windings of coil 25 discussed previously in conjunction with FIG. 1. However, when the position of switch 32 is in the configuration not shown in FIG. 2, namely, the conventional switch position, the positive side of primary winding 26 is connected to the battery source and the negative side of the primary winding is connected to the trigger terminal of junction 30. The trigger would normally be connected to breaker points for use with the conventional ignition. Those having skill in the relevant art will recognize that the conventional switch position of switch 32 places the ignition system in the proper configuration to operate the engine using a conventional breaker point connection.

As previously indicated in conjunction with FIG. 1, the present invention is designed to operate with virtually all possible trigger sources including conventional points. Thus, most of the principal advantages of the present invention may still be obtained by a user who chooses not to combine the invention with one of the more recent innovations in trigger sensor devices, but who chooses instead to implement the triggering of the electronic ignition of the present invention with conventional breaker points. For this purpose, switch 34 is provided and for purposes of explanation this switch is shown in both FIGS. 2 and 3. Switch 34 functions only when the position of switch 32 is in the electronic configuration illustrated in FIG. 2. Switch 34 has no function when switch 32 is in its conventional position.

When the user has selected breaker points for triggering the switching electronic ignition of the invention, switch 34 is closed so that battery current is applied to the points through the trigger terminal of junction 30 in series with a 50 Ohm 3 Watt resistor which limits the trigger current to about 250 milliamps and functions to keep the point contacts relatively clean and free of oxidation. On the other hand, when the user chooses to provide an alternative trigger device such as a magnetic pick-up, an optical trigger, a Hall effect or Wiegand effect apparatus, etc., switch 34 is opened to its electronic position as seen in FIGS. 2 and 3 thereby interrupting the application of current to terminal 6 and preventing the battery voltage from reaching the trigger terminal of junction 30. In either case and irrespective of the position of switch 34, when switch 32 is in its electronic configuration as seen in FIG. 2, the signal applied to the trigger terminal of junction 30 (whether it be grounded or open points or some other sensor device providing the trigger signal), is applied through switch 32 to terminal 5. It will be seen hereinafter in conjunction with FIG. 3 that terminal 5 is connected to the switching electronic ignition to establish the timing of the ignition voltage and current generated by that circuit.

Figure 3A:
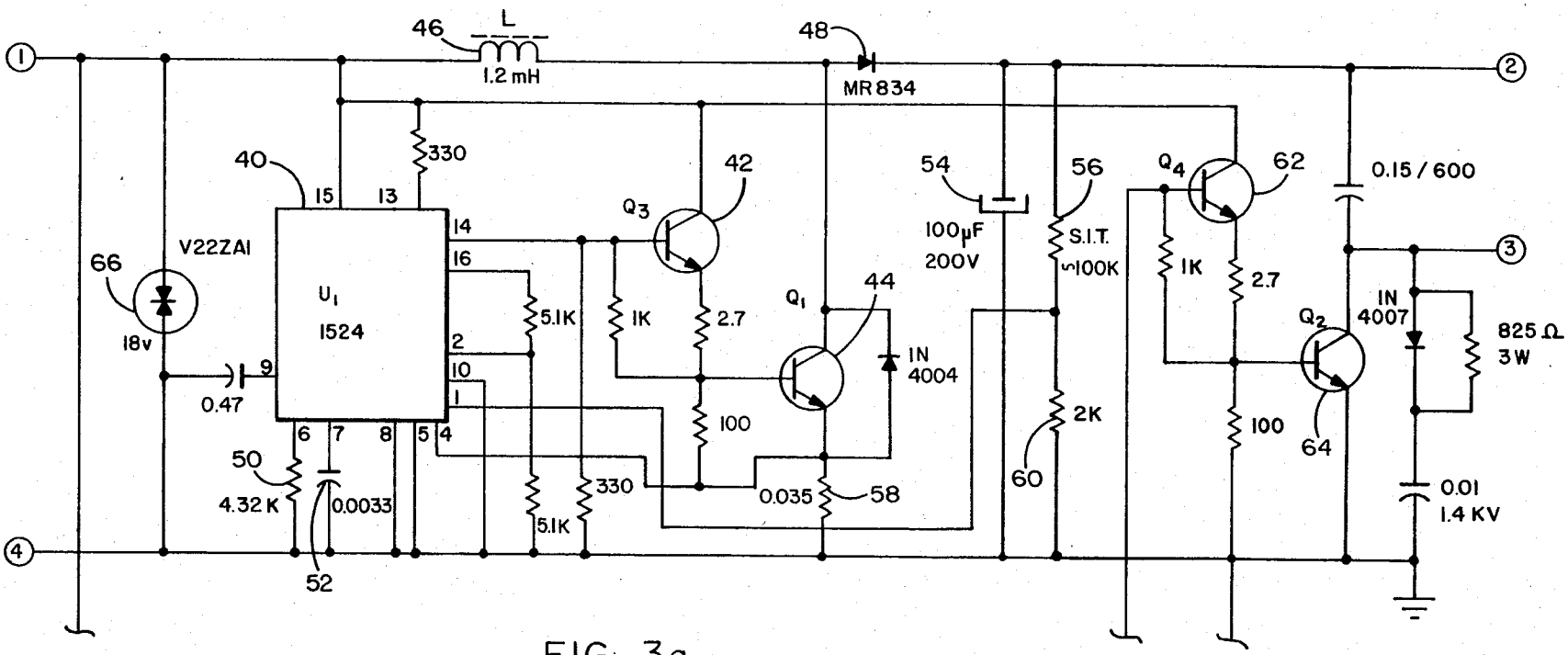
FIGS. 3*a* and 3*b*, is a detailed schematic drawing of the invention.
Figure 3B:
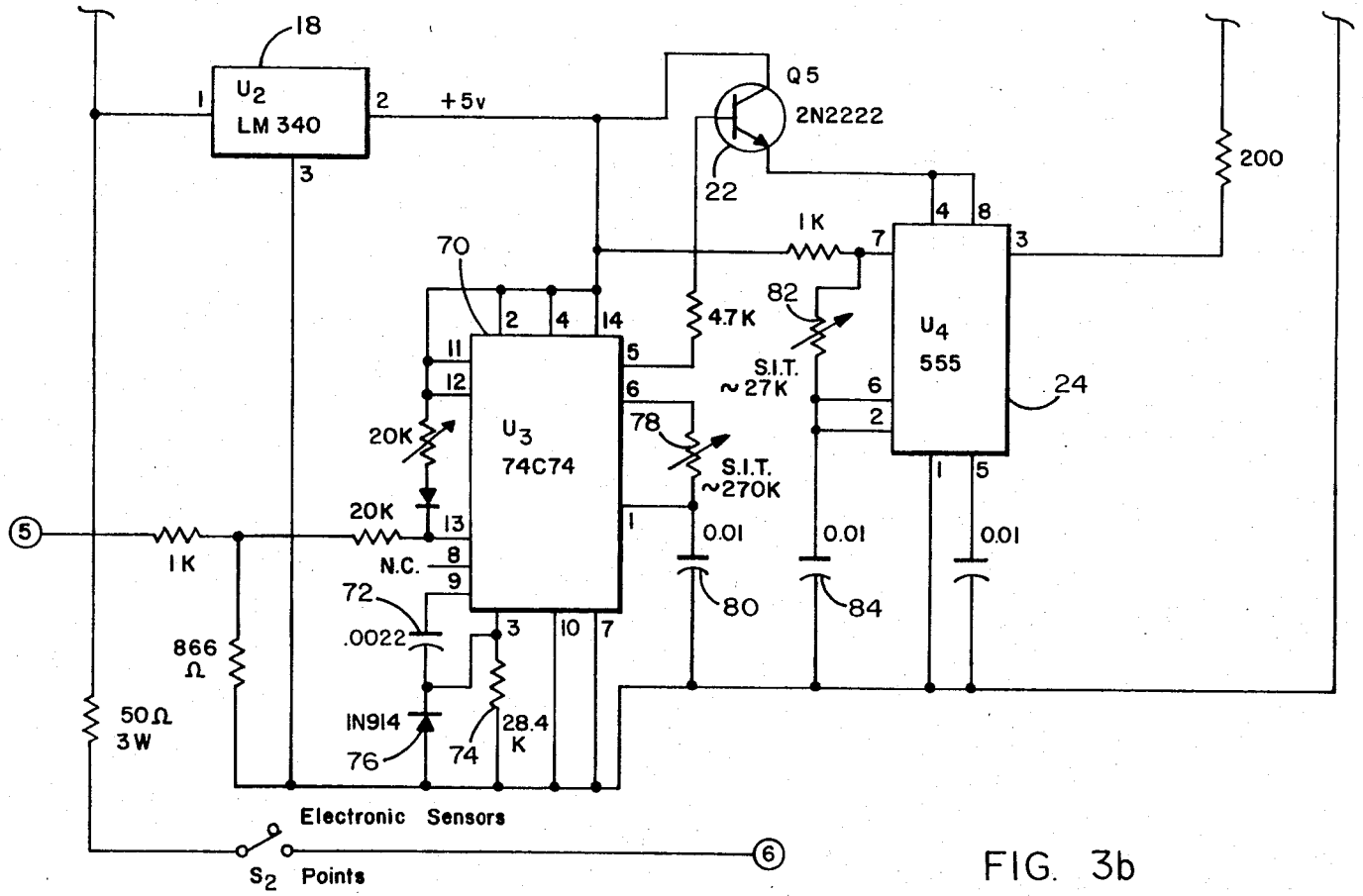

Referring now to FIG. 3 which comprises FIG. 3*a* and 3*b* and initially to FIG. 3*a* in particular, it will be seen that the principal components of high voltage switching regulator 12, solid state power switch 14 and control circuit 16 comprise the following: a pulse width modulator 40, transistors 42 and 44, inductor 46, fast recovery diode 48, resistor 50, capacitor 52, filter capacitor 54, fixed resistors 56, 58 and 60, high voltage power transistors 62 and 64, and a transient suppressor diode or "transzorb" 66.

Pulse width modulator 40 which may for example be a Silicon General model 1524 Switching Regulator, functions to turn transistors 42 and 44 on and off at a frequency determined by resistor 50 and capacitor 52. In the particular embodiment of the invention shown in FIG. 3 the frequency of the combination of modulator 40 and transistors 42 and 44 is greater than 10 kHertz and the duty cycle varies between 0.05 and 0.45. When transistors 42 and 44 are on, an inductor 46 stores energy and this energy is released during the time transistors 42 and 44 are off. As a result, a voltage is developed across inductor 46 and this voltage is rectified by fast recovery diode 48 which in turn charges filter capacitor 54 to a voltage of between 40 and 150 volts depending upon the value of resistor 56 which may be selected during manufacture or test. The value of resistor 56 shown in FIG. 3*a* may vary considerably. All capacitors shown in FIG. 3 are in microfarads. Pulse width modulator 40 limits the flow of current through transistor 44 whenever this current exceeds the ratio of the threshold voltage at pin 4 of modulator 40 to the value of resistor 58. In the embodiment of the invention shown in FIG. 3, threshold voltage at pin 4 of modulator 40 is 0.2 volts rendering the ratio of threshold voltage to the value of resistor 58 equal approximately to 5.7 amps. The output voltage of high voltage switching regulator 12 available at pin 2 as seen in the upper right-hand corner of FIG. 3*a*, will tend to equal a set value determined by the magnitude of resistor 56. When the output voltage is greater than the set value, the voltage drop across resistor 60 becomes greater than the voltage available at pin 2 of modulator 40. As a result, the duty cycle of the combination of modulator 40 and transistors 42 and 44 is reduced thereby reducing the voltage to which capacitor 54 can charge to. The output voltage, which is duty cycle dependent, is thereby reduced to the set value. Conversely, if the output voltage is lower than the set value, the voltage across resistor 60 is lower than the voltage at pin 2 of modulator 40 and the duty cycle of the combination of modulator 40 and transistors 42 and 44 increases thereby increasing the voltage to which capacitor 54 is charged resulting in an increase of output voltage to the set value.

Transistors 62 and 64, which are connected in a Darlington configuration, provide switching between the output voltage available at pin 2 and ground to which the emitter of transistor 64 is connected. Whenever no signal is applied to the base junction of transistor 62, transistor 64 is reversed biased thereby disconnecting ground potential from the primary winding of the ignition coil. However, when a positive signal of sufficient amplitude is applied to the base junction of transistor 62, transistor 64 is turned on and connects the ignition coil winding to ground thereby generating a fast switching flow of current in the primary winding which produces a voltage of up to 40,000 volts in a secondary winding that is connected to the spark plug.

Referring now more specifically to FIG. 3*b*, it will be seen that the low voltage regulator comprises, by way of an example, an LM340 5 volt regulator which applies +5 volts DC to the collector of transistor 22 which functions as the AND gate 22 previously discussed in conjunction with FIG. 1. Low voltage regulator 18 also provides +5 volts DC to signal conditioner and window generator 20 which comprises a dual D-type flip-flop 70 such as a model 74C74. Flip-flop 70 is in turn connected to principal components comprising a capacitor 72, resistor 74, diode 76, resistor 78 and capacitor 80. Capacitor 72 and resistor 74 act as a differentiator for the incoming trigger signal to flip-flop 70 while diode 76 clips the negative portion of the differentiated signal. The trigger input is differentiated to prevent any false triggering due to noise or point bounce and to ensure that the window portion of the circuit operates only on the leading edge of the pulse. Dual flip-flop 70 responds to the differentiated trigger input signal for generating a positive 5 volt signal at the Q output at pin 5 of the dual flip-flop 70. This signal is a square wave with the on time equal to the window generated in response to the trigger. This window signal is applied to the base junction of transistor 22 which acts as an AND gate, the second input thereto being the +5 volts DC provided by low voltage regulator 18 to the collector junction of transistor 22. The output of the AND gate is the operating voltage source that is provided to the pulser 24. When the output of the window generator is pulled high, transistor 22 conducts and thus provides current to pins 4 and 8 of pulser 24. As a result, pulser 24 can only generate output pulses at pin 3 thereof during the period that the window pulse is applied to the base of transistor 22.

Thus, it will be seen that the window pulse dictates the spark duration. Because a long spark duration is needed at low engine speeds, the window duration is a maximum of 2.5 milliseconds at low engine speeds such as 100 RPM and is a minimum of 1.2 milliseconds at high speeds such as 6000 RPM. Within these limits, the window duration is variable dependent upon the engine speed. The window duration is dependent upon the value of resistor 78 and capacitor 80 as well as the frequency of the incoming trigger signal applied to terminal 5. Resistor 78 may be varied considerably from the value shown in FIG. 3*b*. More specifically, pin 6 of flip-flop 70 is the $\overline{Q}$ output of the flip-flop and pin 1 is the reset terminal of the flip-flop. In response to the trigger input, the window signal available at pin 5 of the flip-flop becomes positive, the $\overline{Q}$ signal at pin 6 goes to ground potential and capacitor 80 begins to discharge through resistor 78. When capacitor 80 has been sufficiently discharged, the voltage at pin 1 becomes sufficiently low to result in a resetting of the flip-flop 70. As a result, the duty cycle of the window signal remains substantially constant of about 0.4 but the period of the window pulse varies in inverse proportion to the speed of the engine. As a result, the window duration varies approximately linearly and inversely with the engine speed between about 2000 and 6000 RPM.

As previously indicated, the pulser only generates output pulses during the duration of the window pulse applied to the base of transistor 22. Pulser 24 comprises a timer such as for example, an LM555 timer and is connected in a free running or astable configuration. The pulse frequency is dependent upon the value of resistor 82 and capacitor 84. The value of resistor 82 may vary from that shown in FIG. 3*b*. Typically, the duty cycle is slightly greater than 0.5. In effect, the pulser provides the frequency parameter of the ignition of each spark plug because the pulser output signal applied to the base junction of transistor 62 results in approximately a 40,000 volt secondary winding output upon generation of each pulser output pulse during the window duration.

Figure 4:
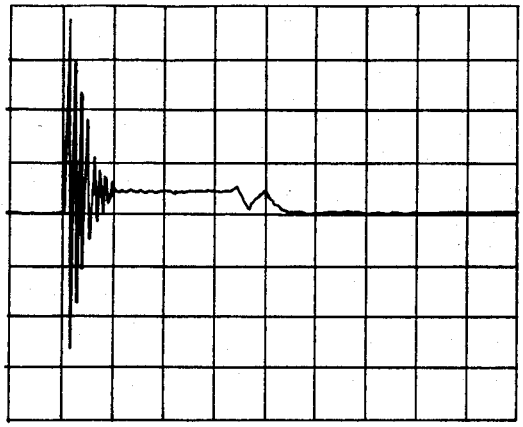
FIGS. 4 and 5 are drawings which represent oscilloscope displays of the voltage across the primary winding of an ignition coil by a conventional ignition system at low and high engine speeds, respectively.
Figure 5:
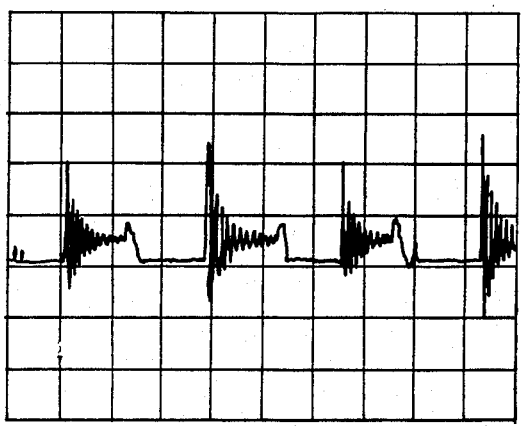

Reference will now be made to FIGS. 4–13 to provide a signal wave form comparison between the present invention and conventional ignition systems as well as electronic ignition systems of the prior art. More specifically, FIGS. 4 and 5 illustrate conventional ignition system output voltages at the primary winding of the ignition coil at low and high engine speeds respectively, where low engine speed is defined as 100 to 2,000 RPM and high engine speed is defined as 3,000 to 6,000 RPM. In each of FIGS. 4 and 5 the vertical scale is 50 volts per division and the horizontal scale is 1 millisecond per division.

As seen in FIG. 4, the conventional ignition system primary winding output voltage has a maximum of less than 200 volts and decays rapidly (i.e., less than 1 millisecond) to a nominal level. The same is true for the high speed wave form shown in FIG. 5 except that because of the high repetition rate of the ignition signal due to the high engine speed, the peak voltage attained for each such signal is only about 150 volts maximum and the instantaneous peak value varies considerably falling close to 100 volts during the third cycle shown in the figure. The disadvantages of conventional ignition systems may be readily perceived. More specifically, the energy delivered to the spark plug is substantially diminished by the rapid decay of the ignition voltage even at low engine speeds, and at high engine speeds the energy is diminished even further and is inconsistent to a great degree from one ignition to the next. The resultant high probability of spark plug misfiring, fouling and the need for frequent engine tune-ups has been mentioned previously.

Figure 6:
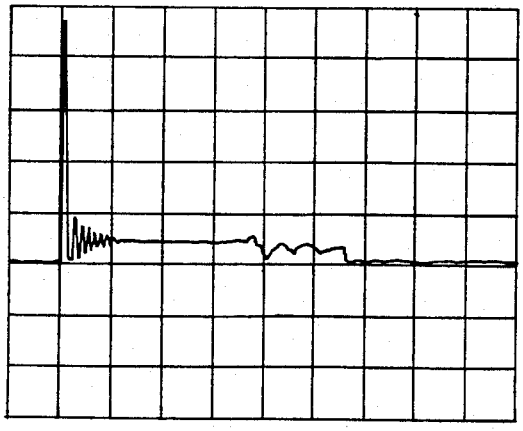
FIGS. 6 and 7 are drawings which represent oscilloscope displays of the voltage across the primary winding of an ignition coil by a typical transistor-inductive ignition system at low and high engine speeds, respectively.
Figure 7:
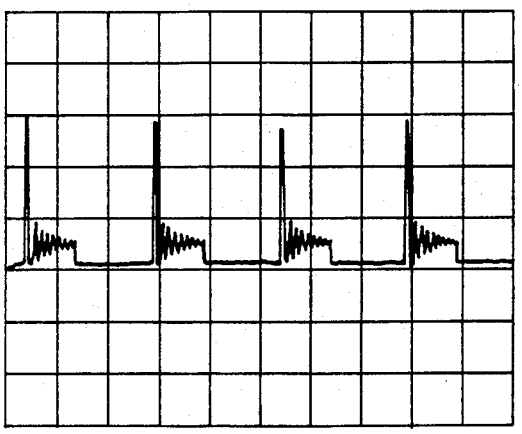

FIGS. 6 and 7 illustrate corresponding wave forms analogous to FIGS. 4 and 5 but for a prior art electronic ignition system of the transistor-inductive type. The vertical and horizontal scales remain the same. In FIG. 6 it is seen that at low engine speeds the prior art electronic ignition system provides a single voltage peak of approximately 240 volts which diminishes rapidly to a nominal voltage level within a small fraction of a millisecond. In FIG. 7 it is seen that at high engine speeds the prior art electronic ignition device has a reduced peak voltage of only about 150 volts and that the low energy, extremely narrow pulse configuration of the device remains substantially the same with some improvement over the conventional ignition system insofar as peak voltage repeatability from ignition cycle to ignition cycle is concerned.

Figure 8:
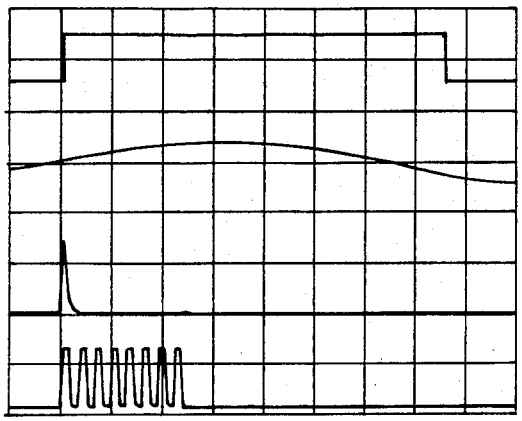
FIGS. 8, 9 and 10 are drawings of oscilloscope displays illustrating output pulses of the pulser of the present invention at three respective engine speeds in response to two illustrated exemplary trigger signals that may be input to the present invention.
Figure 9:
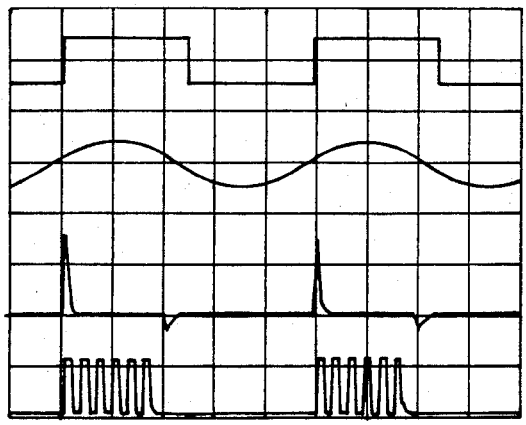
Figure 10:
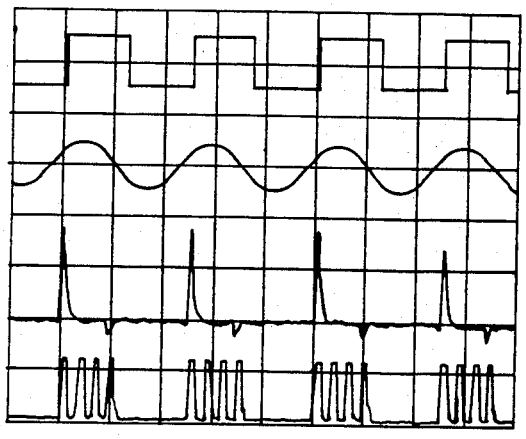

Before discussing the analogous wave forms generated by the present invention, reference will be made to FIGS. 8, 9 and 10 which disclose the relationship between the various possible trigger signals useable in the device and the resultant window pulse generated by signal conditioner and window 20 discussed previously in conjunctions with FIGS. 1 and 3. Each of FIGS. 8, 9 and 10 illustrate four distinct wave forms positioned in a time synchronized manner on the same oscilloscope presentation. In each figure the upper two wave forms represent square wave and sine wave trigger pulse signals respectively with the vertical axis of 1 volt per division. The third trace observing the figure from the top to the bottom, is the respective differentiated signal observed at pin 3 of dual flip-flop 70 described previously in conjunction with FIG. 3*b*. The fourth wave form seen in FIGS. 8, 9 and 10 is the corresponding switching pulse output signal at the base junction of transistor 62 which is the input to the solid state power switch 14 as disclosed previously in conjunction with FIGS. 1 and 3*a*. The vertical scale for the third and fourth wave forms is 2 volts per division. The horizontal scale for all four wave forms is 1 millisecond per division. The wave forms of FIGS. 8, 9 and 10 respectively, represent engine speeds of 1,000 RPM, 3,000 RPM and 6,000 RPM, respectively. As seen in each of these figures, the bottom wave form, corresponding to the pulses in the window, commences with the leading edge of the trigger provided by the differentiated wave form immediately above the window wave form and the duration of the window signal varies substantially linearly and inversely with the engine speed. Thus, as seen in FIGS. 8, 9 and 10 the window duration is 2.5 milliseconds at 1,000 RPM, 1.8 milliseconds at 3,000 RPM and 1.2 milliseconds at 6,000 RPM. Furthermore, it is seen that there is only one window for each trigger irrespective of the duration of the trigger signal.

Figure 11:
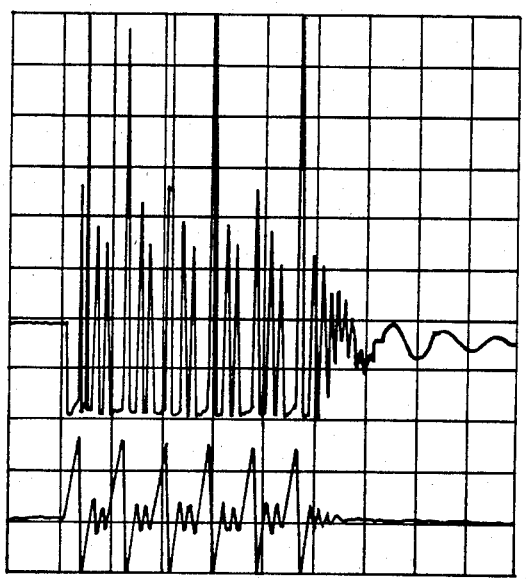
FIGS. 11–13 are drawings of oscilloscope displays illustrating the voltage and current of the present invention at the primary ignition coil at engine speeds of 1,000 RPM, 3000 RPM and 6000 RPM, respectively.
Figure 12:
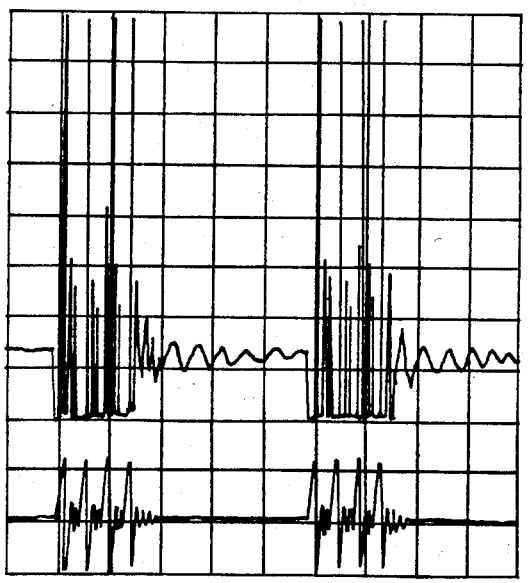
Figure 13:
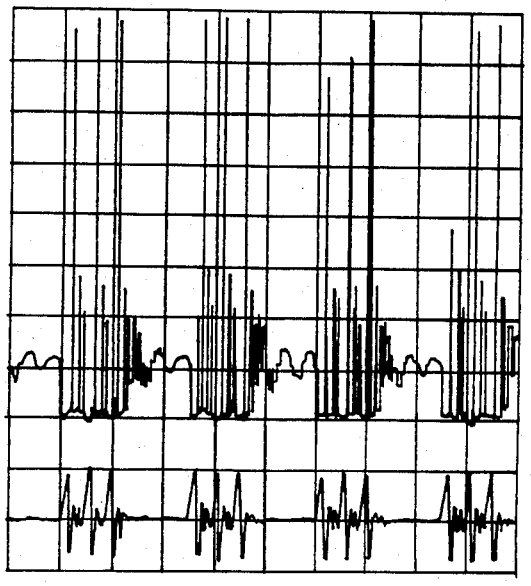

As indicated previously during the discussion of FIG. 3, unlik the prior art ignition systems, in the present invention the output voltage to the primary winding of the ignition coil, comprise a series of rapid, constant, peak voltage pulses, the total duration of which is dictated by the window signal. This attribute and relative advantage of the present invention compared to the prior art may be seen in FIGS. 11, 12 and 13 which illustrate primary winding voltage and current produced by the present invention at engine speeds of 1,000 RPM, 3,000 RPM and 6,000 RPM, respectively. Each of the upper wave forms of FIGS. 11, 12 and 13 represents the primary winding voltage with the vertical scale of 50 volts per division. Each of the lower wave forms of those figures represents the primary winding current with a vertical scale of 5 amps per division. The horizontal scale for the wave form shown in FIG. 11 is 0.5 milliseconds per division and the horizontal scale for the wave forms of FIGS. 12 and 13 is 1 millisecond per division.

In each of FIGS. 11, 12 and 13 it will be seen that the total duration of the ignition signal is the same as the corresponding duration of the window signal for the same engine speed as seen in FIGS. 8, 9 and 10. More importantly, it is seen that the ignition signal voltage comprises a plurality of time sequence peak pulses which have a maximum value of about 400 volts (corresponding to about 40,000 Volts at the secondary winding of a standard ignition coil) and which remain substantially constant for each such pulse irrespective of engine speed. It will also be observed that the primary winding current is of substantially identical duration as the voltage in that winding with repeated constant magnitude current peaks in synchronism with the voltage peaks. As a result it will now be seen that the ignition signal produced by the present invention delivers far more energy to the primary winding of the ignition coil than either conventional ignition systems or prior art electronic ignition systems. Furthermore, it is seen that the voltage peak levels delivered to the primary winding remain substantially constant irrespective of engine speed in contradistinction to conventional ignition systems and prior art electronic ignition systems.

It will now be understood by those having skill in the art to which the present invention pertains that what has been disclosed herein comprises a novel electronic ignition system which produces and delivers to the ignition coil a higher voltage, greater energy output, multiple pulse, high frequency ignition signal which accommodates different types of trigger input signals, obviates the ballast resistor ordinarily needed for conventional ignition systems and provides a substantially constant voltage at all engine speeds. As a result, the previously described problems of both conventional and prior art electronic ignition systems have been either entirely overcome or substantially reduced and thus the likelihood of spark plug fouling, misfiring and the need for frequent engine tune-ups due to such ignition system induced spark plug malfunctions has been obviated.

As a result of the applicant's novel teaching herein disclosed, it will now also be apparent to those having relevant skill that the present invention may be implemented utilizing alternative circuit design as opposed to the herein disclosed currently contemplated best mode of implementation. By way of example, transistors 62 and 64 of the solid state power switch 14 (see FIGS. 1 and 3*a*) may be replaced by a power field-effect transistor such as an MTM3N60. However, all such alternate designs, modifications and additions are deemed to be within the scope of the invention which is to be limited only by the claims appended hereto:

I claim:

1. An electronic ignition system for automobile engines and the like, the engines of the type that employ a battery and at least one spark plug for responding to a trigger source for igniting a fuel mixture as a result of a high voltage derived from the battery and applied to the spark plug through an ignition coil; the ignition system comprising:

a switching regulator having an input connected to said battery and an output of high voltage than available from said battery connected to the primary winding of said ignition coil, a power switch connected to said primary winding and activated for selectively connecting said winding to ground potential for generating a sufficient current in said winding to spark said spark plug with sparks of substantially constant voltage and current, a pulser for generating pulses at a constant frequency and connected to said power switch for activating said switch upon the occurrence of each pulse generated by said pulser, and a signal conditioner and window generator having an input connected to said trigger source and an output connected to said pulser for responding to said trigger source by activating said pulser for a period of time that is inversely proportional to engine speed.

2. The ignition system recited in claim 1 wherein said pulser generates a plurality of successive pulses for sparking said spark plug a plurality of times during each ignition cycle of said fuel mixture.

3. The ignition system recited in claim 2 wherein said plurality of successive pulses generates a minimum of five such sparks.

4. The ignition system recited in claim 2 wherein the higher voltage output to said primary winding of said ignition coil comprises a plurality of pulses which have maximum voltage above ground voltage and minimum voltage below ground voltage.

5. The ignition system recited in claim 1 wherein said switching regulator is adapted for rapidly applying said higher voltage output to said primary winding whereby said spark current remains constant irrespective of engine speed.

6. The ignition system recited in claim 1 wherein said signal conditioner and window generator is responsive to the leading edge of each trigger-source-generated trigger signal whether said trigger device is, a magnetic pick-up device, a magnetic coil, a Hall effect device or a Wiegand effect device.

7. The ignition system recited in claim 1 wherein said period of time is in the range of 1.2 milliseconds to 2.5 milliseconds.

8. The ignition system recited in claim 1 wherein said higher voltage of said switching regulator output is in the range of 40 volts to 150 volts.

9. An electronic ignition system for internal combustion engines and the like, the engines of the type that employ a voltage source and at least one spark plug for responding to a trigger source for igniting a fuel mixture in response to a high voltage derived from the voltage source and applied to the spark plug through an ignition coil; the ignition system comprising:

regulator means connected between said voltage source and the primary winding of said ignition coil for increasing the voltage level applied to said winding, switch means connected to said primary winding and activated for selectively connecting said winding to ground potential for generating a sufficient current in said winding to spark said spark plug with sparks of substantially constant current and voltage, pulser means for generating pulses at a constant frequency and connected to said switch means for activating said switch means upon the occurrence of each pulse generated by said pulse means, and trigger responsive means having an input connected to said trigger source and an output connected to said pulse means for responding to said trigger source by activating said pulse means for a period of time that is inversely proportional to engine speed.

10. The ignition system recited in claim 9 wherein said higher voltage of said regulator means output is in the range of 40 volts to 150 volts.

11. The ignition system recited in claim 9 wherein said pulse means generates a plurality of successive pulses for sparking said spark plug a plurality of times during each ignition cycle of said fuel mixture.

12. The ignition system recited in claim 11 wherein said plurality of successive pulses generates a minimum of five such sparks.

13. The ignition system recited in claim 9 wherein said regulator means is adapted for rapidly applying said higher voltage output to said primary winding whereby said spark current remains constant irrespective of engine speed.

14. The ignition system recited in claim 13 wherein the higher voltage output to said primary winding of said ignition coil comprises a plurality of pulses which have maximum voltage above ground potential and minimum voltage below ground potential.

15. The ignition system recited in claim 9 wherein said trigger responsive means is responsive to the leading edge of each trigger-source-generated trigger signal whether said trigger device is a magnetic pick-up device, a magnetic coil, a Hall effect device or a Wiegand effect device.

16. The ignition system recited in claim 9 wherein said period of time is in the range of 1.2 milliseconds to 2.5 milliseconds.

* * * * *